US005297524A

United States Patent [19]

Fransson et al.

[11] Patent Number: 5,297,524

[45] Date of Patent: Mar. 29, 1994

[54] ARRANGEMENT FOR A FUEL LINE IN AN INTERNAL COMBUSTION ENGINE

[75] Inventors: Hakan Fransson, Björnlunda; Peter Sperle, Nykvarn, both of Sweden

[73] Assignee: Saab-Scania Aktiebolag, Sweden

[21] Appl. No.: 975,552

[22] PCT Filed: Jun. 24, 1992

[86] PCT No.: PCT/SE92/00462

§ 371 Date: Feb. 22, 1993

§ 102(e) Date: Feb. 22, 1993

[87] PCT Pub. No.: WO93/01408

PCT Pub. Date: Jan. 21, 1993

[30] Foreign Application Priority Data

Jul. 2, 1991 [SE] Sweden ..... 9102059

[51] Int. Cl.[5] ..... F02M 55/02

[52] U.S. Cl. ..... 123/468; 123/193.5

[58] Field of Search ..... 123/514, 468, 469, 470, 123/472, 193.3, 193.5

[56] References Cited

U.S. PATENT DOCUMENTS

| | | | |
|---|---|---|---|
| 3,125,078 | 3/1965 | Reiners | 123/468 |
| 3,194,221 | 7/1965 | Dinger et al. | 123/469 |
| 3,402,703 | 9/1968 | Dickerson et al. | 123/469 |
| 3,845,748 | 11/1974 | Eisenberg | 123/468 |
| 3,924,583 | 12/1975 | Jardin | 123/469 |
| 4,485,790 | 12/1984 | Nishimura et al. | 123/468 |

FOREIGN PATENT DOCUMENTS

| | | |
|---|---|---|
| 119948 | 3/1971 | Denmark . |
| 0403871 | 12/1990 | European Pat. Off. . |
| 826216 | 12/1951 | Fed. Rep. of Germany . |
| 1937444 | 4/1971 | Fed. Rep. of Germany . |
| 7300808 | 7/1976 | Sweden . |

*Primary Examiner*—Raymond A. Nelli
*Assistant Examiner*—Thomas Moulis
*Attorney, Agent, or Firm*—Ostrolenk, Faber, Gerb & Soffen

[57] ABSTRACT

A respective fuel injector for each cylinder in a multiple cylinder internal combustion engine. The fuel injectors being supplied with fuel via passages in the cylinder heads of the engine. The passages all open on one side of the engine. On the one side of the engine there is a longitudinal fuel molding with longitudinal channels passing through the molding and ports from each channel communicating with the respective passages in the cylinder heads. The molding is secured to the cylinder heads of the engine. The fuel molding allows simple pipe laying and a protected position for the pipes, and it also reduces the risk of leakage.

18 Claims, 3 Drawing Sheets

ARRANGEMENT FOR A FUEL LINE IN AN INTERNAL COMBUSTION ENGINE

This invention relates to an arrangement for a fuel line for a fuel injector system of an internal combustion engine and particularly to a system including a fuel delivery molding on the engine.

PRIOR ART

In diesel engines for use in heavier trucks, for example, it is conventional for fuel to be supplied to different fuel injectors arranged in the respective combustion chambers. In this case the fuel is fed to each injector under high pressure from a high pressure pump common to all the injectors. This type of fuel injection involves the use of relatively long pipes with many connections between the pump and the injectors. This not only takes a great deal of space but it also requires imposing stringent demands on the pipes and connections to prevent fuel leakage. The pipes are normally located wholly unprotected in the engine compartment and may therefore be easily damaged, which further increases the risk of leakage.

Another type of fuel injector is designed integral with a high pressure pump arranged separately for each injector. In this case every injector is supplied with fuel from a low pressure pump, and the high pressure required for the injection is generated in each injector. This avoids the need for long pipes with many connections exposed to high pressure, thereby reducing the risk of leakage. However, this type of injector requires more pipes than the above-mentioned type. At the same time the space available for these pipes is even more limited due, among other things, to the fact that each injector also requires a drive for performing the pumping function. Normally this drive is provided by means of rocker arms arranged above the injectors, whose movements are controlled by a camshaft. Nevertheless, this type of injector has several advantages. It improves the possibilities of ensuring that the correct quantity of fuel is injected at the right time, which is extremely important in optimising the engine in terms of fuel consumption, power and exhaust emissions, among other things.

A method is known from SE 385 612 for using a fuel line in the form of an extruded aluminium moulding instead of a conventional pipe. The purpose of this is principally to avoid the need for a relatively expensive pipe. To ensure good sealing whilst allowing a certain degree of flexibility for displacements this fuel line must be designed with a thin wall to allow for a certain amount of deformation. However, this type of fuel line requires a great deal of space. In the case of fuel injectors of this type, which require several fuel lines, only limited space is available. Moreover, the installation of this type of fuel line requires that it is able to be extended essentially straight.

OBJECT OF THE INVENTION

The object of this invention is to simplify the fuel lines, including ducts in the cylinder head, together with connections required in the fuel line arrangement for fuel injectors. More specifically, the object is to provide, by simple means, pipes which require little space either inside or outside the cylinder head and to enable the number of connections, and hence the risk of leakage, to be reduced. A further object is to facilitate servicing and repair of the fuel system where this is required. According to the invention this is achieved by designing the arrangement in accordance with the features described below.

BRIEF DESCRIPTION OF THE INVENTION

The invention permits the use of fuel lines which are simple and cheap to produce, and which can also be installed quickly and easily. The invention also enables the fuel lines to be positioned in such a manner that they are protected and the risk of leakage can be reduced.

A further object of the invention is to provide a favourable fuel line route inside the cylinder head of the engine for interacting with outside fuel lines in an engine where the fuel is fed on the same side as the intake air feed to the engine. This is achieved in one embodiment of the invention by means of bores which allow the wall material available in the cylinder head to be used so that the intake port can be installed so that it provides favourable flow conditions, whilst the passage can be connected to external fuel lines through optimum use of available wall surface in the cylinder head.

DESCRIPTION OF THE DRAWINGS

An embodiment exemplifying the invention is described below with reference to the attached drawings, where.

DESCRIPTION OF AN EXEMPLIFYING EMBODIMENT

Figure 1:
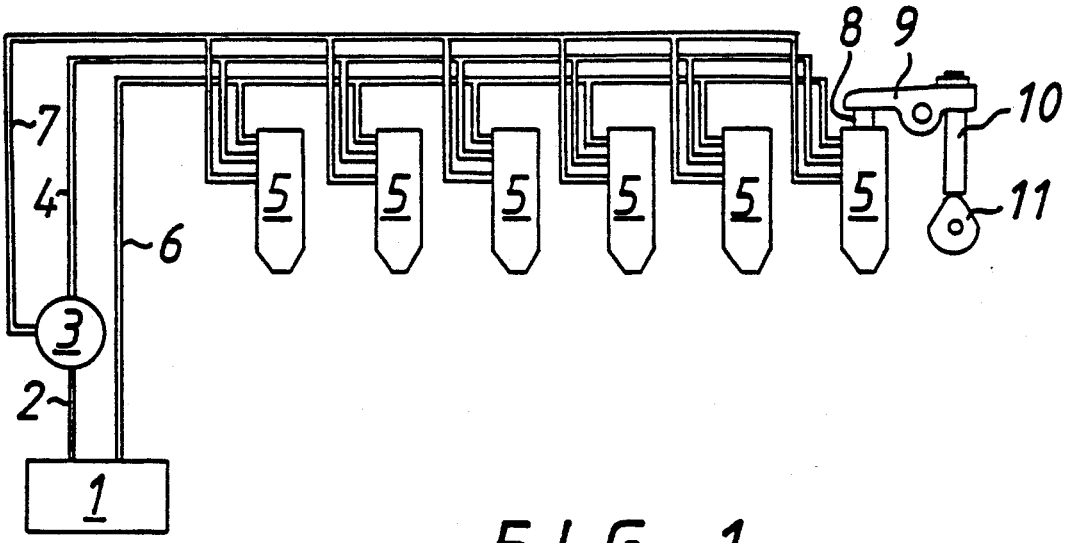
FIG. 1 is a diagrammatic representation of a fuel system.

A fuel system shown diagrammatically in FIG. 1 is designed for use in a multiple cylinder diesel engine 12, for example a six-cylinder in-line engine. It may be designed for a heavier vehicle such as a truck. Fuel from a fuel tank 1 is fed through a suction line 2 to a fuel pump 3, from which fuel is pumped out into a pressure line 4 and on to different fuel injectors 5. The number of fuel injectors 5 corresponds to the number of combustion chambers for engine 12, which is six in this embodiment. A return line 6, in which excess fuel from the respective injectors 5 can be returned to tank 1, is connected to each injector 5. A control pressure line 7, in which fuel of a certain pressure from pump 3 is supplied to the respective injectors 5, for controlling the injection in terms of time relative to the engine speed and/or dependent on other engine parameters, is also connected to each injector 5. The pressure in control pressure line 7 is controlled for this purpose under the influence of an electrical control system, not shown, connected to sensors sensing different engine parameters.

Fuel injectors 5 incorporate pumping elements which are mechanically actuated by a driving mechanism incorporating push rods 8, 10, rocker arms 9 and a camshaft 11 driven by the engine. In FIG. 1 this is shown diagrammatically only for one of fuel injectors 5, but all injectors 5 are driven similarly. In this case camshaft 11 is common to all injectors 5, whilst pushrods 8, 10 and rocker arms 9 are individual for the respective injectors 5. The pumping elements ensure that the fuel fed to injectors 5 is given a high pressure suitable for the injection. The pressure generated by fuel pump 3 is low and only sufficient to ensure that the fuel can safely be supplied to the respective injectors 5. Fuel injectors 5 of this type, with integral pumping elements, are often called injectors, thus this term is used in the remainder of the description. Because both such injectors 5 and the remaining aspects of the design of fuel systems for injectors are well known in themselves, the description does not include them.

Figure 2:
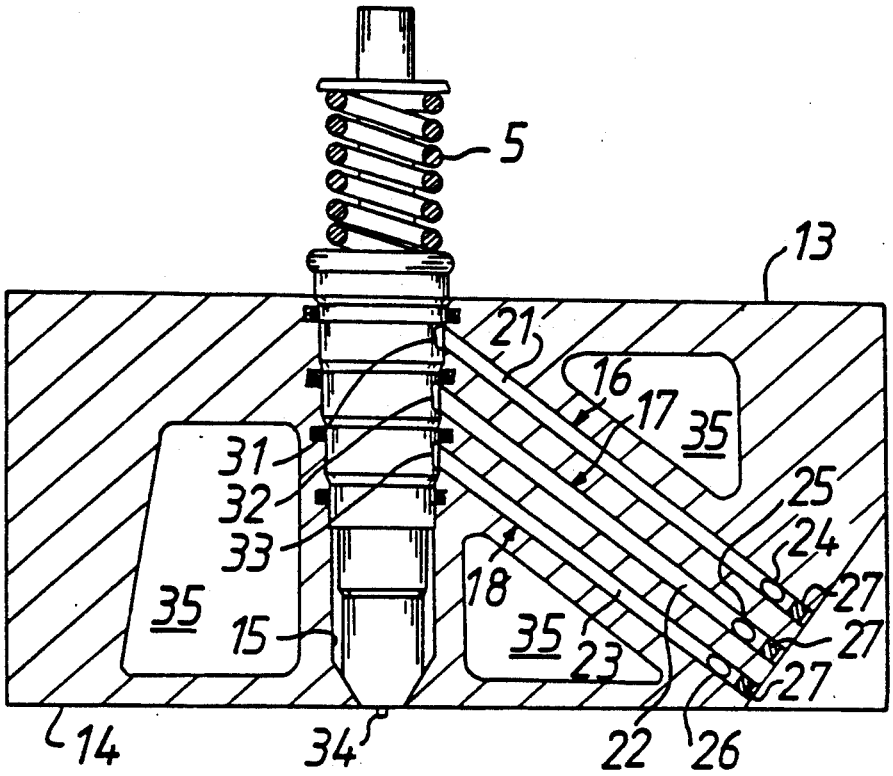
FIG. 2 shows a vertical cross-section along path 5—5 of FIG. 5, through the cylinder head of an engine.
Figure 5:
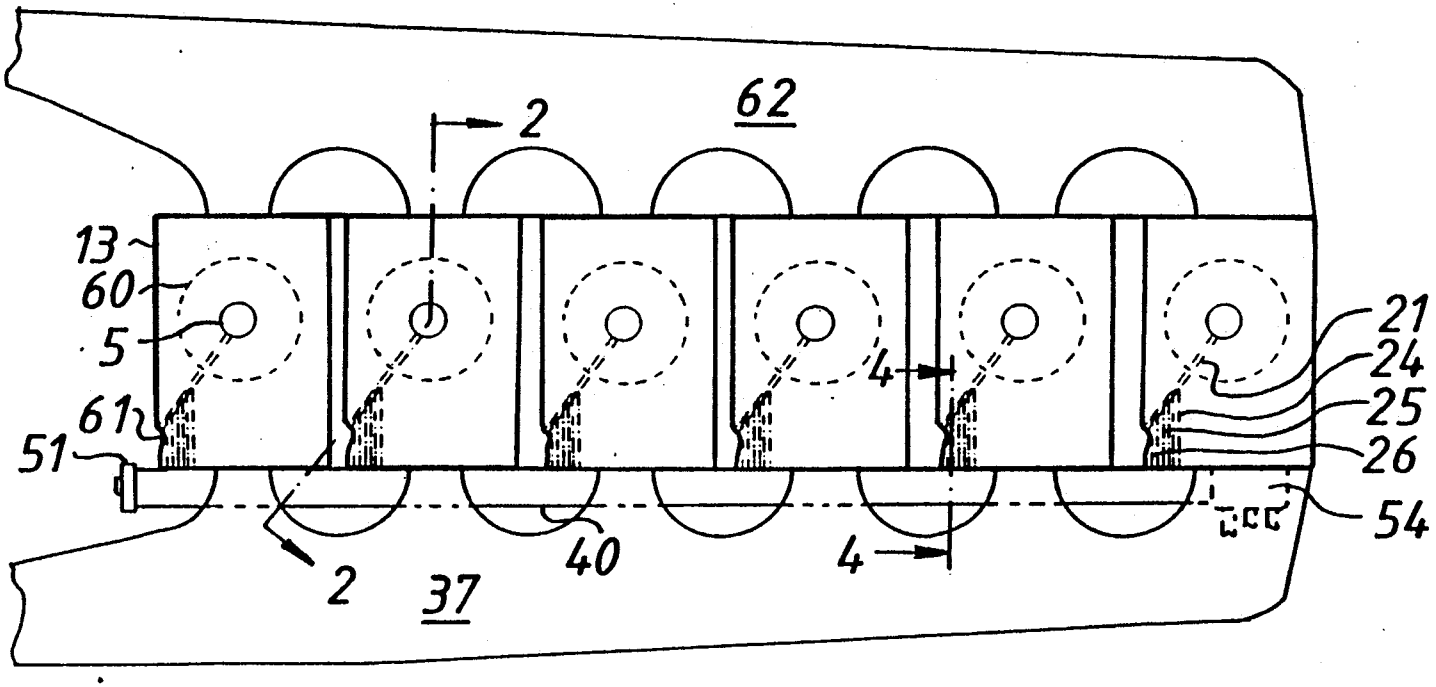
FIG. 5 shows a diagrammatic cross-sectional view of the engine viewed from above.

FIG. 2 shows a vertical cross-section 2—2, according to FIG. 5, of cylinder head 13 of the engine at an injector 5. The engine according to this embodiment is designed with separate cylinder heads 13 for each combustion chamber, and all the cylinder heads have an identical design. The remainder of the description is therefore confined to describing the design of one of cylinder heads 13.

Cylinder head 13 is designed with a lower side 14 secured by means of conventional bolted connections to an engine block in which are arranged cylinders which, together with pistons and the cylinder head, demarcate the combustion chamber of the engine. One of fuel injectors 5 is mountably secured in a vertical through hole 15 in cylinder head 13. The three fuel lines 4, 6, 7 shown diagrammatically in FIG. 1, are connected to injector 5. An upper passage 16 in cylinder head 13 is incorporated in control pressure line 7, a central passage 17 is incorporated in return line 6, and lower passage 18 is incorporated in pressure line 4. Passages 16–18 are designed as bores in cylinder head 13. To enable the bores to be provided in the limited wall surface of cylinder head 13 they are constructed as angular bores. The three bores 21, 22, 23, which are shown in a longitudinal section in the direction of the bores in FIG. 2, have been produced in a first boring operation. Three further bores 24, 25, 26 have been produced in a second boring operation at an angle relative to the first bores 21–23. FIG. 2 only shows the ends of these second bores 24–26 and how they are connected to the first bores 21–23. The first bores 21–23 are sealed by means of sealing plugs 27 in their respective inlet holes.

The second bores 24–26 are produced from the side of cylinder head 13 and have a limited depth sufficient to ensure that bores 24–26 extend into the first bores 21–23. The inlet holes for the second bores 24–26 all open out on one side of engine 12. As will be seen from the description below it is of vital importance to this invention that all the inlets to bores 24–26 have their opening on the same side of engine 12.

Passages 16–18 in cylinder head 13, which are formed by these first and second cylinders 21–26, are used to supply fuel to and from injector 5. These passages 16–18 open out into cylinder head 13 in three separate spaces 31–33 sealed by O rings and communicating directly with different parts of injector 5. A nozzle 34 on injector 5 opens out into the combustion chamber of the engine, injecting into it a suitable proportion of the fuel supplied to injector 5. Because the design of injector 5 is itself well known, and its more detailed design is of no importance for an understanding of this invention, the description does not include this. In an intrinsically conventional manner cylinder head 13 also exhibits a number of coolant passages 35 communicating with the cooling system of the engine. Valves for the combustion chamber and a cam transmission for controlling them are also arranged conventionally in cylinder head 13, but are not shown.

Figure 3:
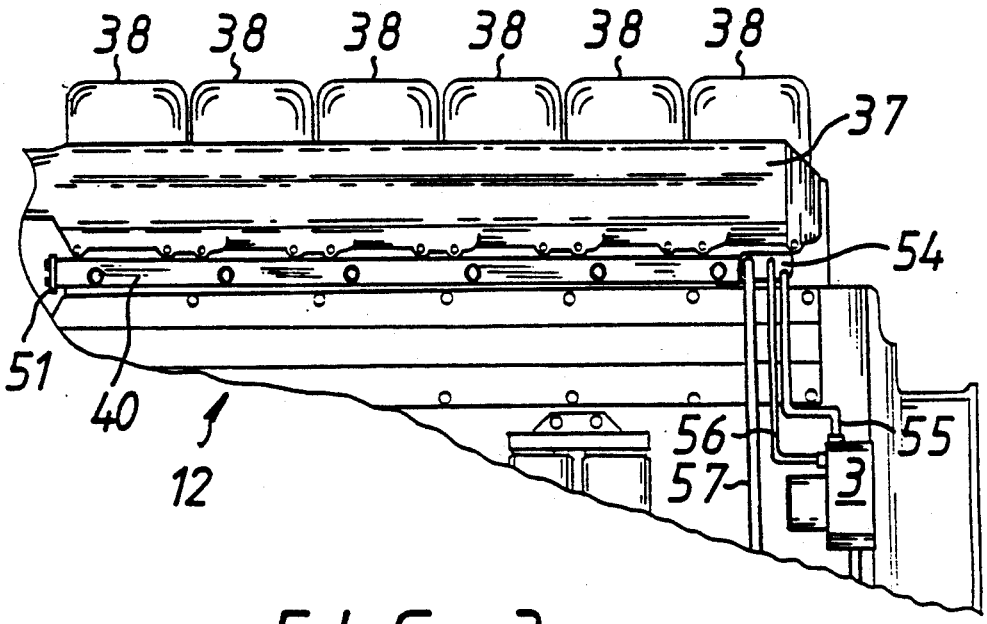
FIG. 3 shows a side view of the engine.

FIG. 3 shows part of a side view of engine 12 and the side of engine 12 on which its intake system is arranged. This incorporates a longitudinal intake manifold 37 for admission of air to engine 12. Its exhaust system is arranged on the other side of engine 12. The respective cylinder heads 13 are covered by separate caps 38. A fuel line according to the invention, designed as a longitudinal moulding 40, extends along engine 12 in the area below intake manifold 37. This moulding is manufactured from extruded aluminium, and exhibits essentially the same cross-sectional shape throughout its length.

Figure 4:
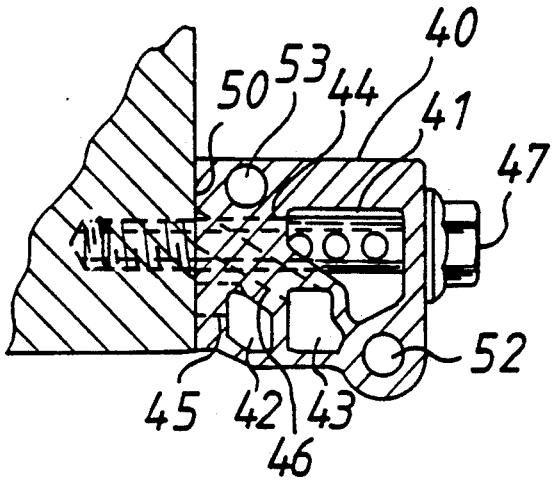
FIG. 4 shows a cross-section at 4—4 in FIG. 5 through a fuel line moulding.

FIG. 4 shows a cross-section 4—4 of the moulding, according to FIG. 5. The openings from passages 16–18 in the respective cylinder heads 13 are arranged along different cross-sections in the longitudinal direction of the engine and moulding 40. Moulding 40 contains three longitudinal channels. A first channel 41 is incorporated in return line 6, a second channel 42 is incorporated in pressure line 4 and a third channel 43 is incorporated in control pressure line 7. Three transverse ducts 44–46 are arranged in moulding 40 in the area provided for the openings of passages 16–18 for the respective cylinder heads 13. The first of these ducts 44 extends transversally through the entire moulding 40 and incorporates a banjo screw 47 by means of which the first channel 41 in moulding 40 communicates with return passage 17 in cylinder head 13. Banjo screw 47 is designed with screw threads which engage in threads in cylinder head 13. Moulding 40 is secured by means of a banjo screw 47 to the respective cylinder heads 13, i.e. a total of six banjo screws 47 for the entire moulding 40.

The second and third channels in the moulding, 42 and 43 respectively, communicate via a second and third duct 45 and 46 respectively with passages 18, 16 in the respective cylinder heads 13. The respective cylinder heads 13 are designed with a smooth surface in the area provided for the openings of the three ducts 44–46, and the corresponding surface on moulding 40 is also smooth. Seals (not shown) for the respective ducts 44–46 are arranged in parting line 50 thereby formed between moulding 40 and the respective cylinder heads 13.

Moulding 40 is provided at one of its ends, the left end in FIG. 3, corresponding to the front end of engine 12, with a sealing cap 51, which engages by means of two screws in two longitudinal holes 52, 53 in moulding 40. Here the front end of engine 12 means the end which, when the engine is mounted longitudinally in a vehicle, is directed forward in the direction of the vehicle and which therefore opposes the rear end of the engine at which its output shaft is arranged. Holes 52, 53 extend along the entire moulding 40 because it has been manufactured as an extruded profile, but only at these ends is it provided with threads for securing both sealing cap 51 at one end and a connecting piece 54 at its other end. The function of sealing cap 51 is to seal the respective channels 41–43 of the moulding at that end.

Connecting piece 54 secured at the other end of moulding 40 is provided with three pipe connection nipples, each communicating with one of channels 41–43 of the moulding. Fuel lines 55, 56, 57 are secured to the pipe connection nipples in the form of pipes connected to fuel pump 3 and tank 1 respectively. These three pipes 55–57 are incorporated in pressure line 4, control pressure line 7 and return line 6 mentioned earlier. Fuel pump 3 is driven by a gear transmission arranged at the rear end of engine 12. Because both connecting piece 54 and fuel pump 3 are arranged at the same end of engine 12, the distance between pipes 55–56 can be made shorter. In an alternative embodiment, in which fuel pump 3 is instead arranged at the front end of engine 12, connecting piece 54 on the moulding should instead be arranged at its front end.

FIG. 5 shows diagrammatically a simplified view, from above, of the different parts of engine 12. The cylinders of the engine, in this case six, are denoted by the reference number 60. Each cylinder head 13 incorporates an injector 5, shown diagrammatically. The three first bores 21–23 are arranged one above the other, which is why only the top bore 21 is shown in the figure. To facilitate the boring operations the respective cylinder heads 13 are designed with a recess 61, from which the first bores 21–23 are bored. The three second bores 24–26, which form an angle with the first bores 21–23, all open out on the same side as intake manifold 37 of the engine. The exhaust manifold 62 of the engine is located on the opposite side of the engine. Underneath intake manifold 37 fuel moulding 40 extends along all cylinder heads 13 and connects to fuel passages 16–18 in the respective cylinder heads 13, as described earlier.

The arrangement with fuel moulding 40 described means that the sections of fuel lines 4, 6, 7 contained in the moulding are well protected against external damage, whilst for servicing it is easy to dismantle the same. Assembly is made similarly easy and the risk of incorrect connection is eliminated. Because moulding 40 is located on the intake side of engine 12 and not on the same side as its exhaust manifold, there is no risk either that the fuel will be heated, thus effective utilisation of the fuel is ensured. The production cost of moulding 40 can be kept low.

By designing the passages in the cylinder head as angular bores they can be provided with the advantages allowed by bores, e.g. in terms of simple production to a high degree of accuracy. By designing the bores at an angle the intake and outlet ports of the engine can be designed in optimum fashion as far as flow conditions for the engine are concerned. The space available for the fuel passages in the cylinder head is very limited, particularly in engines with double intake and/or exhaust ports, and in these cases it is an advantage if the intake and outlet ports can be designed without consideration being given to the fuel passages.

The invention is not limited to the embodiment described but can be modified within the scope of the patent claims attached.

We claim:

1. An arrangement for supplying fuel to fuel injectors in a multiple cylinder internal combustion engine, the engine having a cylinder block, the cylinder block having the cylinders arrayed therealong, the cylinder block having first and second opposite sides at the opposite sides of the array of cylinders;

at least one cylinder head on the cylinder block;

a respective fuel injector for each of the cylinders, the fuel injectors being mounted in the at least one cylinder head;

a fuel pump for being connected to the fuel injectors by the fuel supply arrangement;

the fuel supply arrangement comprising:

a respective set of fuel passages in the at least one cylinder head for each cylinder, all of the passages extending from the first side of the cylinder block and each set of fuel passages extending to the respective fuel injector for each cylinder;

a separate fuel molding mounted to and extending along the one side of the cylinder block and the molding being connectable to the at least one cylinder head; the fuel molding having a set of longitudinal channels extending along the molding and along the cylinder block at least for supplying fuel to and returning fuel from the fuel injectors; for each cylinder, the fuel molding having a set of transverse connection ducts, each duct of each set being connected to one of the channels in the molding, and the ducts extending toward the at least one cylinder head;

the set of cylinder head fuel passages opening on the first side of the cylinder block, each fuel passage in the at least one cylinder head connecting with a respective one of the respective sets of fuel molding connection ducts for that cylinder, whereby fuel supplied to the longitudinal channels is delivered by the ducts to the respective fuel passages in the at least one cylinder head;

means connecting the channels in the fuel molding with the fuel system of the engine at least for supply of fuel to and removal of fuel from the molding.

2. The arrangement of claim 1, wherein the respective set of fuel passages in the at least one cylinder head at each cylinder comprise three passages;

there are at least three of the separate longitudinal channels in the molding, a first one of the channels being incorporated in a fuel feed line, a second one of the channels being incorporated in a fuel return line and a third one of the channels being incorporated in a control pressure line for the fuel system of the engine;

each of the fuel passages in the at least one cylinder head being connected with the respective one of the longitudinal channels through the respective duct between the channel and the passage.

3. The arrangement of claim 1, wherein the fuel molding is comprised of an extruded profile having the channels formed therein and the profile having essentially the same cross sectional shape throughout the length of the fuel molding.

4. The arrangement of claim 3, wherein the fuel molding is formed of an extruded profile of light metal.

5. The arrangement of claim 4, wherein the fuel molding is comprised of aluminum.

6. The arrangement of claim 1, wherein the fuel molding has opposite ends and the means connecting the channel in the fuel molding to the fuel system of the engine is provided at one of the ends of the fuel molding.

7. The arrangement of claim 6, further comprising an intake manifold for combustion air for each of the cylinders, the intake manifold being on the first side of the cylinder block; an exhaust manifold from each of the cylinders, the exhaust manifold being on the second side of the cylinder block;

the fuel molding is mountably secured at the at least one cylinder head on the first side of the cylinder block and away from the exhaust manifolds.

8. The arrangement of claim 6, wherein the means at the one end of the fuel molding connecting the channels to the fuel system comprises a connecting piece which includes connections for connecting the respective channels of the fuel molding to other parts of the fuel system.

9. The arrangement of claim 8, further comprising a mountable sealing cap at the second end of the fuel molding.

10. The arrangement of claim 6, wherein the engine is an in-line engine with each cylinder being in a respective cylinder head and the separate cylinder heads for each cylinder being arrayed in line in the cylinder block.

11. The arrangement of claim 10, wherein the respective fuel passages for each cylinder are in the respective cylinder head and the fuel passages are defined as bores through the cylinder head from the first side of the cylinder block to the respective fuel injectors in the cylinder block.

12. The arrangement of claim 1, wherein the respective fuel passages in the cylinder block are defined as bores through the cylinder block from the first side of the cylinder block to the respective fuel injectors in the cylinder block.

13. The arrangement of claim 12, further comprising a respective transverse screw in the fuel molding at each of the cylinders for securing the fuel molding to the cylinder heads.

14. The arrangement of claim 13, wherein each of the transverse screws includes an internal port included in one of the fuel lines in the molding.

15. The arrangement of claim 12, wherein each of the fuel passages for each cylinder is an angular bore in the cylinder block, incorporating a first bore at an angle to the direction of extension of the fuel molding and a second bore transverse in direction to the molding.

16. The arrangement of claim 15, wherein the fuel passage first bore communicates into a recess for the respective cylinder where the first bore is sealed and the second bore extends between the first bore and the first side of the cylinder head for connection to the fuel molding.

17. The arrangement of claim 1, wherein each cylinder incorporates a respective one of the cylinder heads, and the fuel passages for each cylinder being defined in its cylinder head.

18. The arrangement of claim 2, wherein each cylinder incorporates a respective one of the cylinder heads, and the fuel passages for each cylinder being defined in its cylinder head.

* * * * *